US005906725A

United States Patent [19]

Lin et al.

[11] Patent Number: 5,906,725

[45] Date of Patent: May 25, 1999

[54] METHOD FOR PREPARING NICKEL-ZINC-COPPER OR NICKEL-ZINC ALLOY ELECTROPLATING SOLUTIONS FROM ZINC-CONTAINING WASTE ARTICLES HAVING A NICKEL/COPPER ELECTROPLATING LAYER

[75] Inventors: Jing-Chie Lin; Jyh-Yeong Lin; Tai-Hong Chen, all of Taoyuan; Fong-Ru Yang; Jyh-Herng Chen, both of Hsinchu, all of Taiwan

[73] Assignee: Industrial Technology Research Institute, Hsinchu, Taiwan

[21] Appl. No.: 08/880,995

[22] Filed: Jun. 23, 1997

[51] Int. Cl.[6] ..... C25D 3/58; C25D 3/56; C25D 21/12

[52] U.S. Cl. ..... 205/240; 205/255; 205/82; 205/101

[58] Field of Search ..... 205/238, 239, 205/240, 243, 244, 245, 246, 255, 81, 82, 101

*Primary Examiner*—Kathryn Golgos
*Assistant Examiner*—Thomas H. Parsons
*Attorney, Agent, or Firm*—Bacon & Thomas

[57] ABSTRACT

A zinc-containing waste article is recycled by a method in which the zinc of the waste article is recovered in a molten state while the unmolten nickel/copper electroplating layer of the waste article is dissolved in an acidic solution to form a nickel-zinc alloy or a nickel-zinc-copper alloy electroplating solution.

20 Claims, No Drawings

METHOD FOR PREPARING NICKEL-ZINC-COPPER OR NICKEL-ZINC ALLOY ELECTROPLATING SOLUTIONS FROM ZINC-CONTAINING WASTE ARTICLES HAVING A NICKEL/COPPER ELECTROPLATING LAYER

FIELD OF THE INVENTION

The present invention relates generally to a method for recycling zinc-containing waste articles having multiple electroplating layers of copper/nickel or copper/nickel/chromium, and more particularly to a method for recovering zinc from the zinc-containing waste articles and for preparing a nickel-zinc-copper or nickel-zinc alloy electroplating solution from the multiple electroplating layers of copper/nickel or copper/nickel/chromium of the zinc-containing waste articles.

BACKGROUND OF THE INVENTION

Taiwanese patent application No. 84101011 (Certificate No. Invention 106808) discloses a ferrofluid sink/float separator for separating a mixture of aluminum particles, zinc particles and copper particles, which simulates a typical metal scrap from dumped cars. The zinc-containing articles collected from dumped cars or other sources are generally electroplated with multiple layers of copper/nickel or copper/nickel/chromium. Currently, there is no cost-effective method for recycling the zinc and the copper/nickel or copper/nickel/chromium electroplating layers (hereinafter the "multiple layers of copper/nickel or copper/nickel/chromium" will be referred to as a nickel/copper electroplating layer) of the zinc-containing articles.

SUMMARY OF THE INVENTION

It is therefore the primary objective of the present invention to provide a method for recycling zinc metal from a zinc-containing waste article, such as a body scrap of the motor vehicle.

It is another objective of the present invention to provide a method for preparing a nickel-zinc-copper or nickel-zinc alloy electroplating solution from a zinc-containing waste article containing a nickel/copper electroplating layer.

It is still another objective of the present invention to provide a method for electroplating a nickel-zinc or nickel-zinc-copper alloy with the nickel-zinc or nickel-zinc-copper electroplating solution which is prepared by the method of the present invention.

In keeping with the principle of the present invention, the foregoing objectives of the present invention are attained by a method for preparing a nickel-zinc-copper or nickel-zinc alloy electroplating solution from a zinc-containing waste article having a nickel/copper electroplating layer.

The method of the present invention consists of the following steps of:

(a) heating the zinc-containing waste article at a temperature ranging between the zinc melting point and the copper melting point such that the zinc metal of the zinc-containing waste article is melted, and that the melted zinc metal is separated from the nickel/copper electroplating layer which is not melted at said temperature;

(b) introducing the unmcoten nickel/copper electroplating layer into an acidic solution until the nickel/copper electroplating layer is partially or completely dissolved to form an initial acidic waste solution containing ions of Ni, Zn, Cu, Fe, Cr and Pb;

(c) adjusting the ion concentrations of the ions of Ni, Zn, Cu, Fe, Cr and Pb of the initial acidic waste solution of the step(b) as follows:

$15\ gdm^{-3} < Ni^{2+} < 58\ gdm^{-3}$ $28\ gdm^{-3} < Zn^{2+} < 44\ gdm^{-3}$ $0 < Cu^{2+} < 1430\ gm^{-3}$ $0 < Fe^{2+} + Fe^{3+} < 5000\ gm^{-3}$ $0 < Cr^{3+} < 1000\ gm^{-3}$ $0 < Pb^{2+} < 50\ gm^{-3}$ wherein an electroplating solution suitable for depositing a nickel-zinc alloy is attained as the $Cu^{2+}$ concentration is smaller than 500 $gm^{-3}$; and wherein an electroplating solution suitable for depositing a nickel-zinc-copper alloy is attained as the $Cu^{2+}$ concentration is greater than 500 $gm^{-3}$.

The step (c) of the method of the present invention includes the measurement of ion concentrations of Ni, Zn, Cu, Fe, Cr and Pb in the initial acidic waste solution from the step (b), and may call for the addition of a complementary acidic waste solution to the initial acidic waste solution if one or more of the ions of the initial acidic waste solution are not in conformity with those ion concentrations listed under the step (c).

The complementary acidic waste solution referred to above may be a leach solution of used hooks in nickel electroplating, a solution leached from nickel scrap, a nickel electroplating waste solution, a Watts nickel electroplating waste solution, a Raney nickel leach solution, or a leach solution of a nickel electrode from a post-consuming nickel hydrogen battery.

Preferably, the nickel-zinc-copper alloy electroplating solution of step (c) of the method of the present invention contains a $Ni^{2+}$ ion concentration of about 22 $gdm^{-3}$, and a $Zn^{2+}$ ion concentration of about 35 $gdm^{-3}$.

In addition to the method described above, the present invention discloses further an electroplating method for the nickel-zinc-copper alloy electroplating solution prepared by the method of the present invention. The electroplating method of the present invention consists of electrolysis, in which an article to be electroplated is used as the cathode for carrying out the electrolysis. In the meantime, the nickel-zinc-copper alloy electroplating solution is used as the electrolyte having a pH ranging between 2 and 5, preferably 4. The electrolysis is carried out at a current density ranging between 200 and 500 $Am^{-2}$.

By using the nickel-zinc alloy electroplating solution prepared by the method of the present invention, another electrolysis can be carried out such that an article to be coated is used as the cathode, and that the nickel-zinc alloy electroplating solution is used as the electrolyte. The current density of the electrolysis ranges between 200 and 500 $Am^{-2}$. The pH value of the electrolyte ranges between 2 and 5, preferably 4.

It is recommended that a brightener is added to the electrolyte in the electroplating method of the present invention. The brightener may be glycine, glucose, or ascorbic acid, preferably glycine. The preferred concentration of the brightener added to the electrolyte is about 1000 $gm^{-3}$.

The foregoing objectives, features, functions, and advantages of the present invention will be more readily understood upon a thoughtful deliberation of the following detailed description of the embodiments of the present invention.

DETAILED DESCRIPTION OF THE INVENTION

The present invention will be described explicitly on the basis of the following scheme 1:

Scheme 1

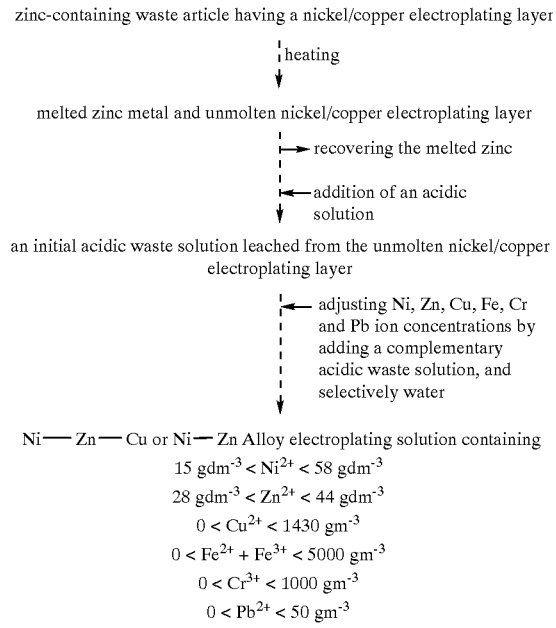

The zinc-containing waste article of Scheme 1 can be obtained from the scrap components of a motor vehicle or machinery. Before such zinc-containing waste article is heated, it is first crushed into pieces within an appropriate range of size. Such pieces are heated at a temperature ranging between the melting points of zinc and copper (melting points: Zn, 419.4° C.; Cu, 1083° C.; Cr, 1615° C.; and Ni, 1452° C.) such that the zinc metal is molten. The molten zinc is then physically separated from the unmolten nickel/copper electroplating layer by decantation or filtration. The molten zinc so recovered can be recycled for casting a new zinc and zinc-containing articles.

The unmolten nickel/copper electroplating layer is dissolved in an acidic solution, such as aqueous solution of $H_2SO_4$ or $HNO_3$. A typical initial acidic waste solution leached from the nickel/copper electroplating layer contains: $Zn^{2+}$ concentration of 100 $gdm^{-3}$, $Ni^{2+}$ concentration of 0.566 $gdm^{-3}$, $Cu^{2+}$ concentration of 0.05 $gdm^{-3}$, $Fe^{2+}$ and $Fe^{3+}$ ion concentration of 10 $gdm^{-3}$, $Cr^{3+}$ concentration of 1 $gdm^{-3}$, and $Pb^{+2}$ concentration of 0.03 $gdm^{-3}$.

For adjusting the metal ion concentrations of such an initial acidic waste solution as mentioned above, a complementary acidic waste solution containing nickel and/or other metal ions may be added to the initial acidic waste solution. In other words, the ion concentrations of Ni, Zn, Cu, Fe, Cr and Pb of the complementary acidic waste solution can serve to supplement the ion concentrations of Ni, Zn, Cu, Fe, Cr and Pb of the initial acidic waste solution. In addition, water contained in the complementary acidic waste solution may serve to bring about a dilution effect. Accordingly, an electroplating solution can be obtained such that it contains the metal ion concentration of Ni, Zn, Cu, Fe, Cr, and Pb as follows:

$15\ gdm^{-3}<Ni^{2+}<58\ gdm^{-3}$ $28\ gdm^{-3}<Zn^{2+}<44\ gdm^{-3}$ $0<Cu^{2+}1430\ gm^{-3}$ $0<Fe^{2+}+Fe^{3+}<5000\ gm^{-3}$ $0<Cr^{3+}<1000\ gm^{-3}$ $0<Pb^{2+}<50\ gm^{-3}$.

A solution suitable for electroplating a nickel-zinc alloy is attained if the $Cu^{2+}$ concentration is smaller than 500 $gm^{-3}$. On the other hand, if the $Cu^{2+}$ concentration is greater than 500 $gm^{-3}$, a solution suitable for electroplating the nickel-zinc-copper alloy is obtained. The complementary acidic waste solution referred to above may be a leach solution of used hooks in nickel electroplating, a solution leached from nickel scrap, a nickel electroplating waste solution, a Watts nickel electroplating waste solution, a Raney nickel leach solution, or a leach solution of a nickel electrode of a waste nickel hydrogen battery.

The electroplating solutions obtained by the method of the present invention may serve as an electrolyte in electrolysis in which an article is electroplated with a Ni—Zn—Cu or Ni—Zi alloy layer. The electrolysis has a current efficiency as high as 90% and over. The electrolysis referred to above can be brought about by a current density ranging between 200 and 500 $Am^{-2}$. In the meantime, the electrolyte (the electroplating solution) of the present invention has a pH value ranging between 2 and 5, preferably 4. It is recommended that a brightener, such as gycine, glucose, or ascorbic acid, be added to the electrolyte such that the concentration of the brightener is about 1000 $gm^{-3}$. The pH value of the electrolyte of the present invention can be kept in the range of 2–5 by adding an alkali, such as ammonium sulfate. The electroplating layer formed by the present invention is semilustrous and gray. According to the ASTM D 3359 test, both electroplating layers of the present invention have an excellent adhesive quality (0-grade). In addition, both electroplating layers formed by the present invention have a hardness and a corrosive resistance both superior to those of a pure nickel electroplating layer or a pure zinc electroplating layer.

EXAMPLES 1–7

$H_2SO_4$ solutions containing a $Ni^{2+}$ concentration of 22 $gdm^{-3}$ and a $Zn^{2+}$ concentration of 35 $gdm^{-3}$ and other metal ions having concentrations listed in Table 1 were used as an electroplating bath and a fixed current density of 200–500 $Am^{-2}$ was used in Ni—Zn—Cu alloy electroplating. The $H_2SO_4$ solutions further contained 13.2 $gdm^{-3}$ of ammonium sulfate so that a pH value of 4 was obtained. In addition, a brightener of glycine 1000 $gm^{-3}$ was added to each of the $H_2SO_4$ solutions. The results are presented in the following Table 1.

TABLE 1

| | Concentration ($gm^{-3}$) | | | | Current density | Hardness | Corrosive resistance | Current efficiency |
|---|---|---|---|---|---|---|---|---|
| Ex. | Cu | Fe | Cr | Pb | ($Am^{-2}$) | (VHN) | (Ohm) | (%) |
| 1 | 953 | 960 | 835 | 18 | 200 | 256 | 268 | 90 |
| 2 | 890 | 985 | 825 | | 300 | 275 | 297 | 91 |
| 3 | 763 | 230 | | 5 | 400 | 304 | 355 | 92 |
| 4 | 763 | | 755 | 11 | 500 | 323 | 374 | 93 |

TABLE 1-continued

| Ex. | Concentration ($gm^{-3}$) Cu | Fe | Cr | Pb | Current density ($Am^{-2}$) | Hardness (VHN) | Corrosive resistance (Ohm) | Current efficiency (%) |
|---|---|---|---|---|---|---|---|---|
| 5 | 1398 | | | 20 | 200 | 432 | 403 | 94 |
| 6 | 171 | 4855 | | | 300 | 278 | 283 | 90 |
| 7 | 1208 | | 900 | | 400 | 286 | 277 | 92 |

On the basis of the data shown in Table 1, it is readily apparent that the hardness and the corrosive resistance of the electroplating layers of the Examples 1–7 are superior to those of the pure nickel electroplating layer and the pure zinc electroplating layer, which have respectively the hardness 130–200 (VHN) and the hardness 100–170 (VHN). The corrosive resistance of the pure nickel electroplating layer and the pure zinc electroplating layer are 180–250 (Ohm) and 140–180 (Ohm), respectively.

EXAMPLES 8–19

$H_2SO_4$ solutions containing a $Ni^{2+}$ concentration of 22 $gdm^{-3}$ and a $Zn^{2+}$ concentration of 35 $gdm^{-3}$ and other metal ions having concentrations listed in Table 2 were used as an electroplating bath and a fixed current density of 200–500 $Am^{-2}$ was used in Ni—Zn—Cu alloy electroplating. The $H_2SO_4$ solutions further contained 13.2 $gdm^{-3}$ of ammonium sulfate so that a pHl value of 4 was obtained. In addition, a brightener of glycine 1000 $gm^{-3}$ was added to each of the $H_2SO_4$ solutions. The results are presented in the following Table 2.

TABLE 2

| Ex. | Concentration ($gm^{-3}$) Cu | Fe | Cr | Pb | Current density ($Am^{-2}$) | Hardness (VHN) | Corrosive resistance (Ohm) | Current efficiency (%) |
|---|---|---|---|---|---|---|---|---|
| 8 | 1430 | 100 | | | 200 | 269 | 112 | 92 |
| 9 | 1430 | 10 | | | 300 | 281 | 201 | 93 |
| 10 | 1430 | 5000 | | | 400 | 284 | 234 | 90 |
| 11 | 1430 | 1000 | | | 500 | 291 | 308 | 95 |
| 12 | 953 | | 90 | | 200 | 251 | 150 | 94 |
| 13 | 953 | | 9 | | 300 | 263 | 223 | 90 |
| 14 | 953 | | 900 | | 400 | 274 | 259 | 92 |
| 15 | 953 | | 450 | | 200 | 285 | 293 | 94 |
| 16 | 477 | | | 5 | 300 | 230 | 187 | 93 |
| 17 | 477 | | | 2 | 400 | 232 | 257 | 94 |
| 18 | 477 | | | 20 | 500 | 247 | 356 | 90 |
| 19 | 477 | | | 10 | 200 | 283 | 394 | 93 |
| 20 | 1003 | 3009 | | 0.9 | 300 | 256 | 268 | 90 |
| 21 | 948 | 3512 | 356 | 1405 | 400 | 286 | 277 | 92 |
| 22 | 1290 | 415 | 12.5 | | 500 | 284 | 234 | 90 |

On the basis of the data shown in Table 2, it is readily apparent that the hardness and the corrosive resistance of the electroplating layers of the Examples 8–11 are superior to those of the pure nickel electroplating layer and the pure zinc electroplating layer if the iron ion concentration ranges from 10 to 5000 $gm^{-3}$ and the current density ranges from 200 to 500 $Am^{-2}$. If the Cr concentration ranges from 9 to 900 $gm^{-3}$ (Examples 12–15) and the current density ranges from 200 to 400 $Am^{-2}$, the hardness and the corrosive resistance of the electroplating layers are superior to those of the pure nickel electroplating layer and the pure zinc electroplating layer. If the Pb ion concentration ranges from 2 to 20 $gm^{-3}$ (Examples 16–19) and the current density ranges from 200 to 500 $Am^{-2}$, the hardness and the corrosive resistance of the electroplating layers are superior to those of the pure nickel electroplating layer and the pure zinc electroplating layer.

SEM analysis of the electroplating layers of the Examples 8–19 were conducted for the surface crystal morphology. The crystal grains of the electroplating layers were finer so that the crystal grain size decreased from about 7 $\mu$m to about 1 $\mu$m when the current density was increased from 200 to 500 $Am^{-2}$, thereby resulting in the increase in the hardnesss.

In the following Examples 20–22, the leaching solutions and the electroplating waste solutions listed as follows were used for preparing the Ni—Zn—Cu alloy electroplating solutions:

| Solution* | Concentration, $gm^{-3}$ Ni | Zn | Cu | Fe | Pb | Cr |
|---|---|---|---|---|---|---|
| A | 9700 | | 5000 | 16500 | | |
| B | 30 | 7000 | 80 | 20 | | 25 |
| C | 10 | 120000 | 10 | 30 | 3 | |
| D | 114000 | 100 | 4650 | 58 | 20 | 30 |
| E | 566 | 100000 | 50 | 10000 | 30 | 1000 |

*A: a leach solution of used hooks in nickel electroplating; B: a leach solution of zinc cast scrap; C: a zinc electroplating waste solution; D: a solution leached from nickel scrap; E: a leach solution of a Cr/Ni/Cu electroplating layer of zinc cast scrap

EXAMPLE 20

200 ml of A solution and 300 ml of C solution were mixed and then diluted by 500 ml of water such that an electroplating solution containing a zinc ion concentration of 36 $gdm^{-3}$, a nickel ion concentration of 19.4 $gdm^{-3}$, a copper ion concentration of 1003 $gm^{-3}$, an iron ion concentration of 3009 $gm^{-3}$, and a Pb ion concentration of 0.9 $gm^{-3}$ was obtained. To the electroplating solution glycine was added so that the electroplating solution had a glycine concentration of 1000 $gm^{-3}$. The electroplating was carried out at room temperature and with a current density of 300 $Am^{-2}$. The hardness and the corrosive resistance of the nickel-zinc-copper alloy electroplating layer are shown in Table 2 and are superior to those of the electroplating layers of pure zinc and pure nickel.

EXAMPLE 21

200 ml of D solution and 350 ml of E solution were mixed and then diluted by 450 ml of water such that an electroplating solution containing a zinc ion concentration of 35 $gdm^{-3}$, a nickel ion concentration of 23 $gdm^{-3}$, a copper ion concentration of 948 $gm^{-3}$, an iron ion concentration of 3512 $gm^{-3}$, a Cr ion concentration of 356 $gm^{-3}$, and a Pb ion concentration of 1405 $gm^{-3}$ was obtained. To the electroplating solution glycine was added so that the electroplating solution had a glycine concentration of 1000 $gm^{-3}$. The electroplating was carried out at room temperature and with a current density of 400 $Am^{-2}$. The hardness and the corrosive resistance of the nickel-zinc-copper alloy electroplating layer are shown in Table 2 and are superior to those of the electroplating layers of pure zinc and pure nickel.

EXAMPLE 22

250ml of A solution and 500 ml of B solution were mixed and then diluted with 250 ml of water such that an electroplating solution containing a zinc ion concentration of 35 $gdm^{-3}$, a nickel ion concentration of 24.4 $gdm^{-3}$, a copper ion concentration of 1290 $gm^{-3}$, an iron ion concentration of 415 $gm^{-3}$, and a Cr ion concentration of 12.5 $gm^{-3}$ was obtained. To the electroplating solution glycine was added so that the electroplating solution had a glycine concentration of 1000 $gm^{-3}$. The electroplating was carried out at room temperature and with a current density of 500 $Am^{-2}$. The hardness and the corrosive resistance of the nickel-zinc-copper alloy electroplating layer are shown in Table 2 and are superior to those of the electroplating layers of pure zinc and pure nickel.

What is claimed is:

1. A method for preparing a nickel-zinc-copper or nickel-zinc alloy electroplating solution from zinc-containing waste articles having a nickel/copper electroplating layer, said method comprising the steps of:

(a) heating said zinc-containing waste articles at a temperature ranging between zinc melting point and copper melting point such that zinc metal is melted and separated from the nickel/copper electroplating layer which remains unmolten;

(b) dissolving the unmolten nickel/copper electroplating layer in an acidic solution such that an initial acidic waste solution is obtained; and (c) adjusting ion concentrations of Ni, Zn, Cu, Fe, Cr and Pb contained in the initial acidic waste solution as follows:

$15\ gdm^{-3}<Ni^{2+}<58\ gdm^{-3}$
$28\ gdm^{-3}<Zn^{2+}<44\ gdm^{-3}$
$0<Cu^{2+}<1430\ gm^{-3}$
$0<Fe^{2+}+Fe^{3+}<5000\ gm^{-3}$
$0<Cr^{3+}<1000\ gm^{-3}$
$0<Pb^{2+}<50\ gm^{-3}$ in which an electroplating solution suitable for electroplating a nickel-zinc alloy is obtained when the $Cu^{2+}$ concentration is smaller than 500 $gm^{-3}$; and in which an electroplating solution suitable for electroplating a nickel-zinc-copper alloy is obtained when the $Cu^{2+}$ concentration is greater than 500 $gm^{-3}$.

2. The method as defined in claim 1, wherein the step (c) includes the measurement of ion concentrations of Ni, Zn, Cu, Fe, Cr and Pb in the initial acidic waste solution from the step (b), and a complementary acidic waste solution and optionally water are added to the initial acidic waste solution when one or more measured ion concentrations are not in the range of the ion concentrations specified in the step (c), so as to ensure that the ion concentrations of Ni, Zn, Cu, Fe, Cr and Pb of the resulting solution are in conformity with the ion concentrations specified in the step (c).

3. The method as defined in claim 2, wherein the complementary acidic waste solution is a leach solution of used hooks in nickel electroplating, a solution leached from nickel scrap, a nickel electroplating waste solution, a Watts nickel electroplating waste solution, a Raney nickel leach solution, or a leach solution of a nickel electrode from a post-consuming nickel hydrogen battery.

4. The method as defined in claim 1, wherein the electroplating solution resulting from the step (c) has a $Ni^{2+}$ concentration of about 22 $gdm^{-3}$ and a $Zn^{2+}$ concentration of 35 $gdm^{-3}$.

5. A method for electroplating a nickel-zinc-copper alloy on an article with the nickel-zinc-copper alloy electroplating solution, said method comprising the steps of:

(a) heating zinc-containing waste articles having a nickel/copper electroplating layer at a temperature ranging between zinc melting point and copper melting point such that zinc metal is melted and separated from the nickel/copper electroplating layer which remains unmolten;

(b) dissolving the unmolten nickel/copper electroplating layer in an acidic solution such that an initial acidic waste solution is obtained;

(c) adjusting ion concentrations of Ni, Zn, Cu, Fe, Cr and Pb contained in the initial acidic waste solution as follows:

$15\ gdm^{-3}<Ni^{2+}<58\ gdm^{-3}$
$28\ gdm^{-3}<Zn^{2+}<44\ gdm^{-3}$
$500\ gm^{-3}<Cu^{2+}<1430gm^{-3}$
$0<Fe^{2+}+Fe^{3+}<5000\ gm^{-3}$
$0<Cr^{3+}<1000\ gm^{-3}$
$0<Pb^{2+}<50\ gm^{-3}$; and (d) conducting an electrolysis reaction to form a nickel-zinc alloy layer on said article, in which said article to be electroplated is used as a cathode, the adjusted solution resulting from step (c) is used as an electrolyte of said electrolysis reaction, and a current density of 200–500 $Am^2$ is used, wherein said electrolyte has a pH value of 2–5.

6. The method as defined in claim 5, wherein the pH value of the electrolyte is 4.

7. The method as defined in claim 5, wherein the electrolyte contains a brightener which is added to the electrolyte.

8. The method as defined in claim 7, wherein the brightener is glycine, glucose, or ascorbic acid.

9. The method as defined in claim 7, wherein the concentration of the brightener is about 1000 $gm^{-3}$.

10. The method as defined in claim 8, wherein the brightener is glycine.

11. The method as defined in claim 5, wherein the step (c) includes the measurement of ion concentrations of Ni, Zn, Cu, Fe, Cr and Pb in the initial acidic waste solution from the step (b), and a complementary acidic waste solution and optionally water are added to the initial acidic waste solution when one or more measured ion concentrations are not in the range of the ion concentrations specified in the step (c), so as to ensure that the ion concentrations of Ni, Zn, Cu, Fe, Cr and Pb of the resulting solution are in conformity with the ion concentrations specified in the step (c).

12. The method as defined in claim 11, wherein the complementary acidic waste solution is a leach solution of used hooks in nickel electroplating, a solution leached from nickel scrap, a nickel electroplating waste solution, a Watts nickel electroplating waste solution, a Raney nickel leach solution, or a leach solution of a nickel electrode from a post-consuming nickel hydrogen battery.

13. A method for electroplating a nickel-zinc alloy on an article with the nickel-zinc alloy electroplating solution, said method comprising the steps of:

(a) heating zinc-containing waste articles having a nickel/copper electroplating layer at a temperature ranging between zinc melting point and copper melting point such that zinc metal is melted and separated from the nickel/copper electroplating layer which remains unmolten;

(b) dissolving the unmolten nickel/copper electroplating layer in an acidic solution such that an initial acidic waste solution is obtained;

(c) adjusting ion concentrations of Ni, Zn, Cu, Fe, Cr and Pb contained in the initial acidic waste solution as follows:

$15\ gdm^{-3} < Ni^{2+} < 58\ gdm^{-3}$ $28\ gdm^{-3} < Zn^{2+} < 44\ gdm^{-3}$ $0 < Cu^{2+} < 500\ gm^{-3}$ $0 < Fe^{2+} + Fe^{3+} 21 < 5000\ gm^{-3}$ $0 < Cr^{3+} < 1000\ gm^{-3}$ $0 < Pb^{2+} < 50\ gm^{-3}$; and (d) conducting an electrolysis reaction to form a nickel-zinc alloy layer on said article, in which said article to be electroplated is used as a cathode, the adjusted solution resulting from step (c) is used as an electrolyte of said electrolysis reaction, and a current density of 200–500 $Am^{-2}$ is used, wherein said electrolyte has a pH value of 2–5.

14. The method as defined in claim 13, wherein the pH value of the electrolyte is 4.

15. The method as defined in claim 13, wherein the electrolyte contains a brightener which is added to the electrolyte.

16. The method as defined in claim 15, wherein the brightener is glycine, glucose, or ascorbic acid.

17. The method as defined in claim 15, wherein the concentration of the brightener contained in the electrolyte is about 1000 $gm^{-3}$.

18. The method as defined in claim 16, wherein the brightener is glycine.

19. The method as defined in claim 13, wherein the step (c) includes the measurement of ion concentrations of Ni, Zn, Cu, Fe, Cr and Pb in the initial acidic waste solution from the step (b), and a complementary acidic waste solution and optionally water are added to the initial acidic waste solution when one or more measured ion concentrations are not in the range of the ion concentrations specified in the step (c), so as to ensure that the ion concentrations of Ni, Zn, Cu, Fe, Cr and Pb of the resulting solution are in conformity with the ion concentrations specified in the step (c).

20. The method as defined in claim 19, wherein the complementary acidic waste solution is a leach solution of used hooks in nickel electroplating, a solution leached from nickel scrap, a nickel electroplating waste solution, a Watts nickel electroplating waste solution, a Raney nickel leach solution, or a leach solution of a nickel electrode from a post-consuming nickel hydrogen battery.

* * * * *